US009217989B2

(12) United States Patent
Kichise et al.

(10) Patent No.: US 9,217,989 B2
(45) Date of Patent: Dec. 22, 2015

(54) PROCESS UNIT AND IMAGE FORMING APPARATUS INCORPORATING SAME

(71) Applicants: Mitsutoshi Kichise, Osaka (JP); Kenji Nakamura, Osaka (JP); Takeshi Yamashita, Osaka (JP); Tamotsu Ikeda, Osaka (JP); Minoru Toyoda, Hyogo (JP); Yasuhide Matsuno, Osaka (JP)

(72) Inventors: Mitsutoshi Kichise, Osaka (JP); Kenji Nakamura, Osaka (JP); Takeshi Yamashita, Osaka (JP); Tamotsu Ikeda, Osaka (JP); Minoru Toyoda, Hyogo (JP); Yasuhide Matsuno, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/506,780

(22) Filed: Oct. 6, 2014

(65) Prior Publication Data

US 2015/0117901 A1 Apr. 30, 2015

(30) Foreign Application Priority Data

Oct. 24, 2013 (JP) ..... 2013-220979
Nov. 20, 2013 (JP) ..... 2013-239982

(51) Int. Cl.
*G03G 21/16* (2006.01)
*G03G 21/18* (2006.01)
*G03G 15/08* (2006.01)

(52) U.S. Cl.
CPC ..... *G03G 21/1814* (2013.01); *G03G 15/0896* (2013.01); *G03G 2215/0132* (2013.01)

(58) Field of Classification Search
CPC ..... G03G 21/1842; G03G 21/18; G03G 21/1853; G03G 21/1814
USPC ..... 399/111
See application file for complete search history.

(56) References Cited

U.S. PATENT DOCUMENTS

| | | | | |
|---|---|---|---|---|
| 6,564,034 | B1 * | 5/2003 | Abe | 399/350 |
| 2007/0036569 | A1 * | 2/2007 | Taguchi et al. | 399/49 |
| 2009/0052960 | A1 * | 2/2009 | Tanaka et al. | 399/358 |
| 2009/0190939 | A1 * | 7/2009 | Satoh et al. | 399/34 |
| 2012/0099898 | A1 * | 4/2012 | Ochi et al. | 399/159 |
| 2012/0114348 | A1 * | 5/2012 | Suzuki et al. | 399/53 |
| 2013/0236217 | A1 * | 9/2013 | Nagatomo et al. | 399/281 |

FOREIGN PATENT DOCUMENTS

JP 2006-003733 1/2006

* cited by examiner

*Primary Examiner* — Walter L Lindsay, Jr.
*Assistant Examiner* — Frederick Wenderoth
(74) *Attorney, Agent, or Firm* — Harness, Dickey & Pierce

(57) ABSTRACT

A process unit includes a rotatable image bearer to bear a toner image on a surface thereof; a developer bearer to supply developer to the image bearer and including a first range, a second range different in property from the first range and adjacent to the first range on an outer side in an axial direction via a first boundary, and a second boundary on an outer side of the first boundary in the axial direction; a cleaning member to remove residual developer from the image bearer; and an abutment part disposed to contact the surface of the image bearer to remove a foreign substance from the image bearer. The abutment part is disposed astride at least one of a first position on the image bearer corresponding to the first boundary, and a second position on the image bearer corresponding to the second boundary.

17 Claims, 13 Drawing Sheets

PROCESS UNIT AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2013-220979, filed on Oct. 24, 2013, and 2013-239982, filed on Nov. 20, 2013, in the Japan Patent Office, the entire disclosure of each of which is hereby incorporated by reference herein.

BACKGROUND

1. Technical Field

Embodiments of the present invention generally relate to a process unit and an image forming apparatus, such as a copier, a printer, a plotter, or a multifunction peripheral (MFP) having at least two of copying, printing, facsimile transmission, plotting, and scanning capabilities, that incorporates the process unit.

2. Description of the Related Art

Image forming apparatuses, such as copiers, facsimile machines, and MFPs (or multifunction machines) having such capabilities, typically include a rotatable image bearer, such as a photoconductor drum, to bear a toner image and a developing device provided with a developing roller to supply toner, as developer, to the photoconductor drum. The toner image on the photoconductor drum is transferred onto a recording medium such as a sheet of paper. The developing device further includes a supply roller to supply toner to the developing roller.

The developing roller rotates while contacting the photoconductor drum and the supply roller. Since friction is thus generated on a surface thereof, it is preferred that the developing roller have relatively high degrees of slidability and durability. Preferable image formation can be attained when the developing roller supplies toner uniformly to the photoconductor drum.

Additionally, an edge of a regulation blade and a seal member to inhibit leak of toner contact axial end portions of the developing roller. Since friction is generated between the developing roller and these components, it is preferred that the slidability and durability are higher in the axial end portions of the developing roller.

To attain reliable image formation, slidability and abrasion resistance of the developing roller may be enhanced by, for example, surface treatment, coating, or machining of the entire developing roller or such processing of the axial end portions.

SUMMARY

An embodiment of the present invention provides a process unit that includes a rotatable image bearer to bear a toner image on a surface thereof, a developer bearer to supply developer to the image bearer, a cleaning member to remove residual developer from the surface of the image bearer, and an abutment part disposed to contact the surface of the image bearer to remove a foreign substance from the image bearer. The developer bearer includes a first range, a second range different in property from the first range and adjacent to the first range outside in an axial direction of the developer bearer via a first boundary, and a second boundary positioned on an outer side of the first boundary in the axial direction of the developer bearer. The abutment part is disposed astride at least one of a first position and a second position on the image bearer. The first position corresponds to the first boundary of the developer bearer, and the second position corresponds to the second boundary of the developer bearer.

Another embodiment provides an image forming apparatus that includes the process unit described above and a transfer device to transfer an image formed by the process unit onto a recording media.

Another embodiment provides a process unit that includes the above-described image bearer, a developer bearer to supply developer to the image bearer, the developer bearer, the above-described cleaning member, and an abutment part disposed to contact the surface of the image bearer to remove a foreign substance from the image bearer. The developer bearer includes a first range, a second range different in property from the first range and adjacent to and outside the first range in an axial direction of the developer bearer via a first boundary, and a second boundary to define an end of a developer layer range in the axial direction of the developer to bear a layer of developer. The abutment part is disposed on at least one of a first line extending to the image bearer from the first boundary of the developer bearer, and a line extending to the image bearer from the second boundary of the developer bearer.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
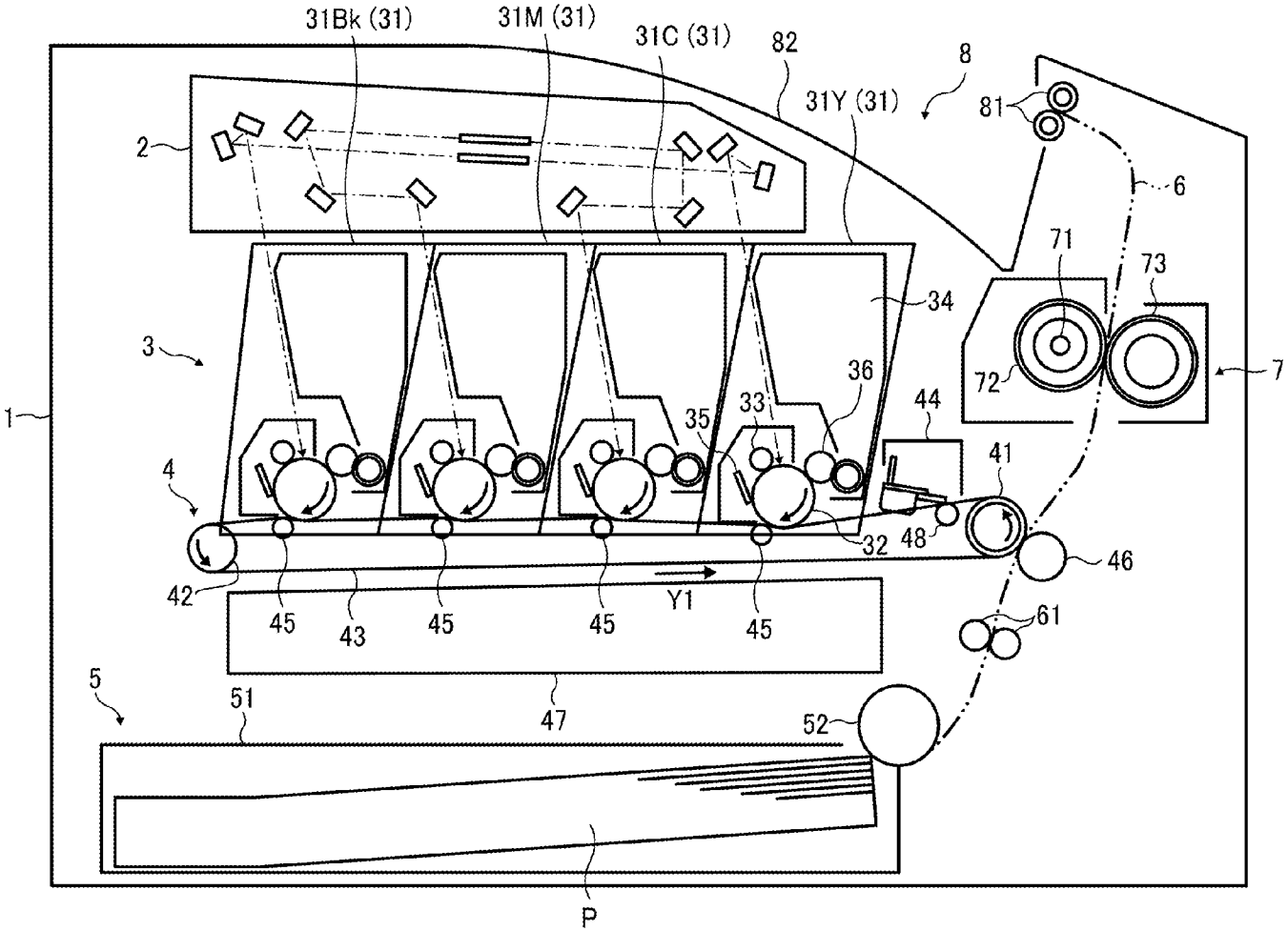
FIG. 1 is a schematic view illustrating an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be understood that and redundant descriptions are omitted or simplified below.

An image forming apparatus 1 shown in FIG. 1 includes an exposure unit 2, an image forming unit 3, a transfer device 4, a sheet feeding unit 5, a conveyance channel 6, a fixing device 7, and a discharge section 8.

The exposure unit 2 is positioned in an upper portion of the image forming apparatus 1 and includes a light source to emit laser beams and various optical system components. Specifically, image data obtained from an image capture such as a scanner is decomposed into color separation components. The exposure unit 2 includes an optical writing device to irradiate photoconductor drums 32 of the image forming unit 3 with laser beams according to the respective color separation components, thereby exposing surfaces thereof.

The image forming unit 3 is positioned beneath the exposure unit 2 and includes multiple process units 31Y, 31C, 31M, and 31Bk removably installable in the image forming apparatus 1. Each process unit 31 includes the photoconductor drum 32 serving as a rotatable image bearer to bear a toner image, a charging roller 33 to uniformly charge the surface of the photoconductor drum 32, a developing device 34 to supply toner to the photoconductor drum 32, and a cleaning blade 35 serving as a cleaning member to remove residual toner (i.e., residual developer) to clean the surface of the photoconductor drum 32.

It is to be noted that the process units 31Y, 31C, 31M, and 31Bk respectively correspond to yellow (Y), cyan (C), magenta (M), and black (Bk) toner corresponding to decomposed color components of full-color images and have a similar configuration except the color of developer contained therein. Accordingly, subscript representing the color attached to the reference numeral thereof and related components may be omitted when color discrimination is not necessary.

The transfer device 4 is positioned vertically beneath the image forming unit 3. The transfer device 4 includes an endless intermediate transfer belt 43 rotatably stretched around a driving roller 41 and a driven roller 42, a belt cleaning blade 44 to remove toner from the intermediate transfer belt 43 to clean the surface of the intermediate transfer belt 43, a cleaning backup roller 48 made of metal, disposed facing the belt cleaning blade 44, primary-transfer rollers 45, and the like. The primary-transfer rollers 45 face, via the intermediate transfer belt 43, the respective photoconductor drums 32 of the process units 31. Each primary-transfer roller 45 is pressed against an inner circumferential face of the intermediate transfer belt 43, and a nip between the intermediate transfer belt 43 and the corresponding photoconductor drum 32 is called a primary-transfer nip. The driving roller 41 and the driven roller 42 are supported by a side plate.

Additionally, a secondary-transfer roller 46 is disposed facing the driving roller 41 via the intermediate transfer belt 43. The secondary-transfer roller 46 is pressed against an outer circumferential face of the intermediate transfer belt 43, and a nip therebetween is called a secondary-transfer nip. Toner removed by the belt cleaning blade 44 is transported through a waste-toner conveying hose and contained in a waste-toner box 47 disposed beneath the intermediate transfer belt 43.

The sheet feeding unit 5 is positioned in a lower portion of the image forming apparatus 1 and includes a sheet feeding tray 51 that contains sheets P of recording media and a feed roller 52 to send out the sheets P.

The sheet P sent from the sheet feeding unit 5 is transported through the conveyance channel 6. A pair of registration rollers 61 and pairs of conveyance rollers are disposed along the conveyance channel 6 up to the discharge section 8.

The fixing device 7 includes a fixing roller 72 heated by a heat source 71 and a pressure roller 73 to press against the fixing roller 72.

The discharge section 8 is provided at extreme downstream in the conveyance channel 6. The discharge section 8 includes a pair of paper ejection rollers 81 and a sheet tray 82 on which the discharged sheet P is stacked.

Referring to FIG. 1, operation of the image forming apparatus 1 is described.

In the image forming apparatus 1, when image formation is started, the photoconductor drum 32 in each process unit 31 is uniformly charged with a bias applied from a high-pressure power source of the charging roller 33. The bias includes direct-current (DC) voltage or a DC component superimposed with an alternating-current (AC) component. The charged photoconductor drum 32 is then exposed according to image data by the optical writing device of the exposure unit 2. Thus, an electrostatic latent image is formed thereon. Each photoconductor drum 32 is exposed accordingly single color data, namely, yellow, cyan, magenta, or black color data decomposed from full-color image data to be recorded. The electrostatic latent images formed on the photoconductor drums 32 are developed into toner images with toner supplied by respective developing rollers 36 of the developing devices 34. For example, in exposure, a laser beam scanner using a laser diode or a light-emitting diode (LED) serving as a light-emitting element is used.

Subsequently, as the driving roller 41 of the transfer device 4 rotates counterclockwise in FIG. 1, the intermediate transfer belt 43 rotates in the direction indicated by arrow Y1. The predetermined voltage (i.e., transfer bias voltage), polarity of which is opposite of toner, is applied to the respective primary-transfer rollers 45, thus generating transfer electrical fields in the primary-transfer nips. The transfer bias voltage may be a constant voltage or voltage controlled in constant-current control method. The transfer electrical fields generated in the primary-transfer nips transfer the toner images from the respective photoconductor drums 32 of the process units 31 and superimpose them one on another on the intermediate transfer belt 43. Thus, a multicolor toner image is formed on the outer circumferential face the intermediate transfer belt 43.

Meanwhile, when image formation is started, in the lower portion of the image forming apparatus 1, the feed roller 52 of the sheet feeding unit 5 starts rotating, sending out the sheet P from the sheet feeding tray 51 to the conveyance channel 6. Then, the registration rollers 61 forward the sheet P to the secondary-transfer nip between the secondary-transfer roller 46 and the driving roller 41 opposed thereto, timed to coincide with the toner image on the intermediate transfer belt 43. At that time, the transfer bias voltage whose polarity is opposite that of the toner image on the intermediate transfer belt 43 is applied to the secondary-transfer roller 46, and thus the transfer electrical field is generated in the secondary-transfer nip. The transfer electrical field generated in the secondary-transfer nip transfers the superimposed toner images from the intermediate transfer belt 43 onto the sheet P at a time.

The sheet P carrying the toner image is separated from the intermediate transfer belt 43 due to curvature of the secondary-transfer roller 46 and transported to the fixing device 7. In the fixing device 7, the sheet P is heated and pressed by the fixing roller 72 heated by the heat source 71 and the pressure roller 73. Thus, the toner image is fixed thereon. Subsequently, the sheet P is separated from the fixing roller 72 and transported by a pair of conveyance rollers to the discharge section 8, where the paper ejection rollers 81 discharge the sheet P to the sheet tray 82. The belt cleaning blade 44 removes toner remaining on the intermediate transfer belt 43 after image transfer. The toner thus removed is transported by a screw and the like through the waste-toner conveying hose to the waste-toner box 47.

The intermediate transfer belt 43 is preferably an endless belt made of resin film produced by dispersing a conductive material such as carbon black in a material such as polyvinylidene fluoride (PVDF), ethylene tetrafluoroethylene copolymer (ETFE), polyimide (PI), polycarbonate (PC), thermoplastic elastomer (TPE), and the like.

Additionally, urethane rubber can be used for the belt cleaning blade 44. The primary-transfer roller 45 can be a conductive sponge roller, a metal roller, or the like. A conductive blade may be used instead. The secondary-transfer roller 46 includes a metal core and a conductive, elastic body overlying the metal core. The secondary-transfer roller 46 can include a conductive roller, an electron conductive type roller, and the like.

It is to be noted that, although the description above concerns multicolor (i.e., full-color) image formation, alternatively, single color, bicolor, and three color images may be formed using one, two, or three out of the four process units 31.

Figure 2:
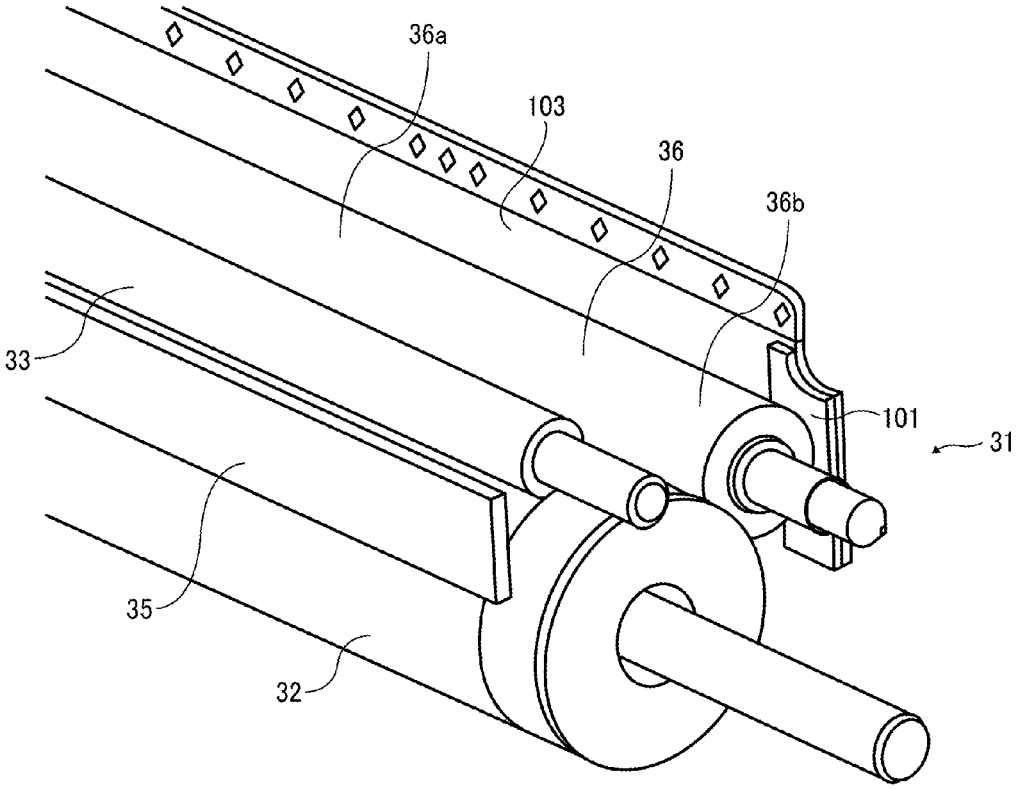
FIG. 2 is a perspective view illustrating a process unit of the image forming apparatus shown in FIG. 1.

FIG. 2 is a perspective view illustrating the process unit 31. In FIG. 2, the configuration is simplified for ease of understanding.

As shown in FIG. 2, the process unit 31 includes the photoconductor drum 32, the charging roller 33, the cleaning blade 35, a toner seal 101, and the developing device 34 (shown in FIG. 1) including the developing roller 36 and a regulation blade 103. The charging roller 33, the developing roller 36, and the cleaning blade 35 are disposed along a circumference of the photoconductor drum 32 to face the photoconductor drum 32. The toner seal 101 and the regulation blade 103 face the developing roller 36.

As described above, the photoconductor drum 32 is charged by the charging roller 33, exposed by the exposure unit 2, supplied with toner by the developing roller 36 to develop a latent image thereon into a toner image, and cleaned by the cleaning blade 35. Then, the toner image is transferred onto the intermediate transfer belt 43. The regulation blade 103 contacts the developing roller 36 and regulates the thickness of toner on the surface of the developing roller 36. Then, a layer of toner is borne on the developing roller 36.

In FIG. 2, reference characters 36*a* and 36*b* are respectively given to a first range (i.e., an axial center range) and a second range of the developing roller 36 on an outer side of the first range 36*a* in the axial direction thereof. The toner seal 101 is disposed in the second range 36*b* in contact therewith to inhibit leak of toner to the outside of the process unit 31. In addition, an edge of the regulation blade 103 contacts the second range 36*b*. In rotation of the developing roller 36, friction is generated between the second range 36*b* and the components in contact therewith, namely, the toner seal 101 and the regulation blade 103. Accordingly, the second range 36*b* is required of higher degrees of slidability and abrasion resistance than those of the first range 36*a*. Thus, a surface of the second range 36*b* is varied in property (e.g., slidability, abrasion resistance, or the like), state, or structure (e.g., surface roughness) from that of the first range 36*a*. The surface of the second range 36*b* is varied also aiming at improving circulation of toner, increasing hardness of the second range 36*b* to secure contact pressure, and the like.

For example, the surface property of the second range 36*b* can be varied by coating the second range 36*b*, changing surface roughness, or the like. Such approach can improve the abrasion resistance of the second range 36*b*, and the process unit 31 becomes capable of reliable image formation for a long time.

However, the inventors of the present invention recognize that, when the surface property, state, or structure of the developing roller is different in the axial direction thereof (for example, between end portions and a center portion), the amount of toner supplied from the developing roller 36 to the photoconductor drum 32 and the amount of charge of toner transported differ between areas divided by the boundary at which the state or property differs. That is, the boundary serves as a base of change. In the configuration shown in FIG. 2, the developing roller 36 includes the first range 36*a* and the second ranges 36*b* adjacent in axial position and different in property (or surface state), and the amount of toner supplied from the developing roller 36 to the photoconductor drum 32 and the amount of charge of toner transported tend to differ at the boundary therebetween.

This can increase the possibility of inconveniences such as firm adherence of substances such as toner, free substances such as silica released from toner, paper dust, and talc component (i.e., foreign substances) to the photoconductor drum 32. In this case, there is a risk that the substances adhering to the photoconductor drum 32 abrade the cleaning blade 35 and the developing roller 36. Then, insufficient cleaning and image failure can arise.

Additionally, typically, developing rollers include a range where a toner layer is formed (i.e., a toner layer range) and a no toner range where the toner layer is not formed, is positioned outside the toner layer range in the axial direction. Substances such as toner and free substances released therefrom can adhere to a position on the photoconductor drum corresponding to the boundary of the toner layer range of the developing roller.

Figure 9:
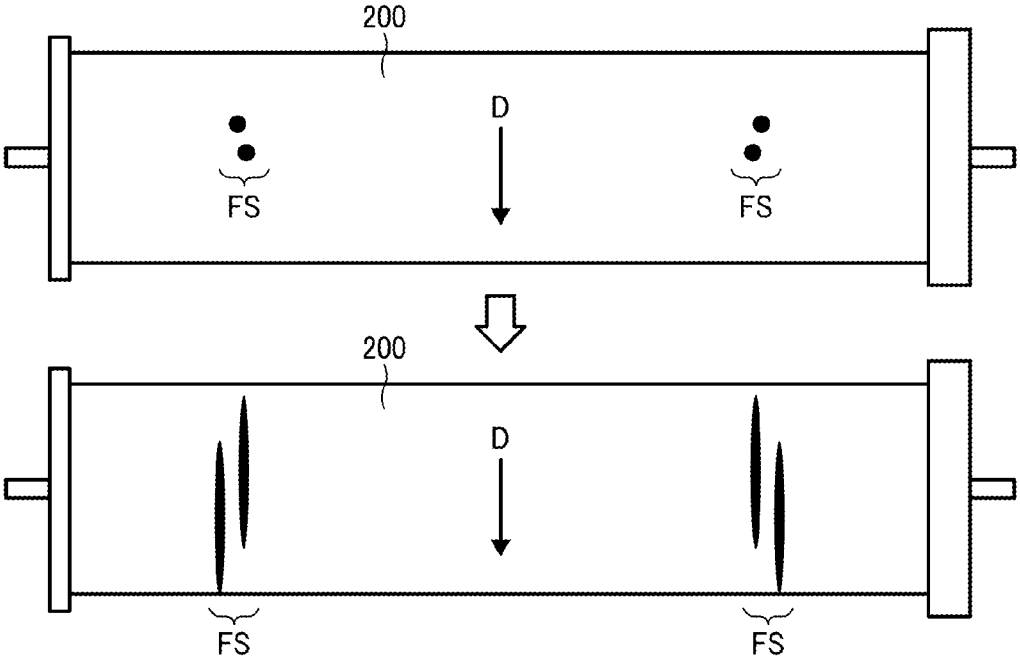
FIG. 9 illustrates toner or the like adhering to a photoconductor drum and increases in size of adherence thereof.

FIG. 9 is a schematic diagram of a typical photoconductor drum 200 for understanding of increases in the amount of toner adhering thereto and adverse effects on image formation.

Referring to FIG. 9, a lump of toner and the like adheres to the photoconductor drum 200 as foreign substances FS. As the photoconductor drum 200 rotates in the direction indicated by arrow D, the foreign substances FS are rubbed against components such as a toner seal member adjacent to the photoconductor drum 200. Then, the adhering substances spread linearly in the direction opposite the direction in which the photoconductor drum 200 rotates and affect image formation.

Thus, although durability of the developing roller and fluidity of toner can be enhanced by surface property of the developing roller as described above, there is a risk that the difference in surface property of the developing roller causes toner and the like to adhere to the photoconductor drum and disturbs image formation.

In view of the foregoing, embodiments described in this specification can provide a process unit capable of reliable image formation, in particular, a process unit capable of inhibiting adherence of substances a photoconductor drum in areas adjacent to the above-described boundary.

Figure 3A:
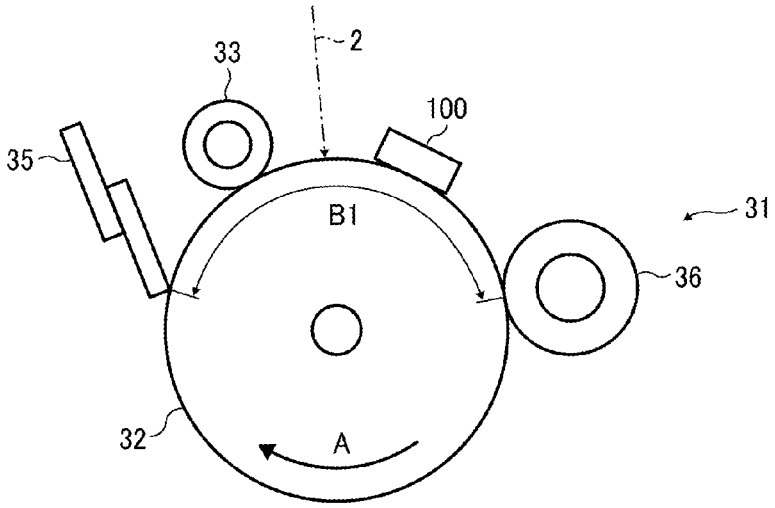
FIGS. 3A and 3B are respectively a schematic end-on axial view and a schematic side view of a process unit according to a first embodiment.
Figure 3B:
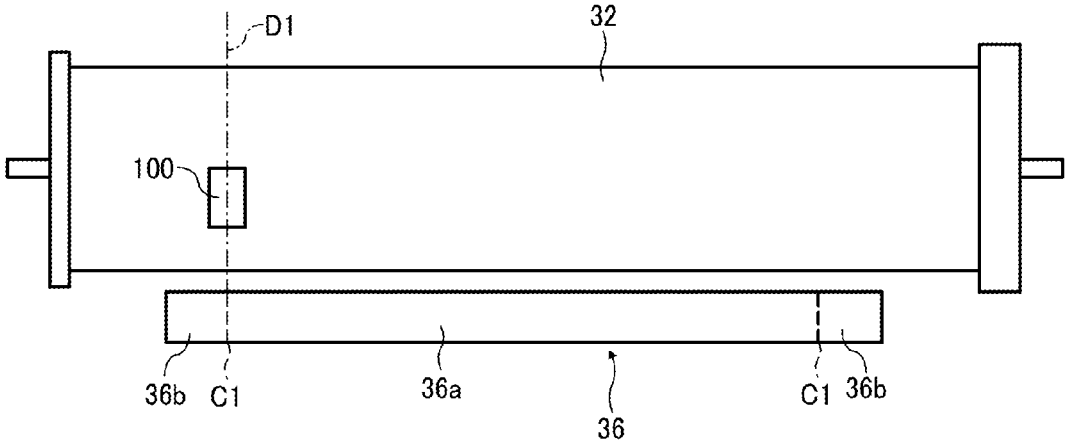

FIGS. 3A and 3B are respectively a schematic end-on axial view and a schematic side view of the process unit 31 according to a first embodiment.

As shown in FIG. 3A, in the process unit 31 according to the first embodiment, an abutment part 100 is disposed facing the photoconductor drum 32.

The abutment part 100 is disposed in a range B1 of the surface of the photoconductor drum 32 in the direction indicated by arrow A, in which the photoconductor drum 32 rotates (hereinafter "rotation direction A"). The range B1 is downstream from the cleaning blade 35 and upstream from the developing roller 36 in the rotation direction A. In particular, the abutment part 100 is positioned between the developing roller 36 and the position irradiated by the exposure unit 2 in the rotation direction A as shown in FIG. 3A.

When the abutment part 100 is in the range from the position cleaned by the cleaning blade 35 to the position supplied with toner from the developing roller 36, collision of toner against the abutment part 100 can be reduced, thus inhibiting soil inside the process unit 31 caused by scattering of toner or the like.

As shown in FIG. 3B, in the axial direction, the developing roller 36 includes the first range 36*a* and the second ranges 36*b* different in surface layer state. The developing roller 36 and the photoconductor drum 32 face each other with their axes oriented in an identical or similar direction.

The abutment part 100 is disposed to contact the surface of the photoconductor drum 32 and astride a first position opposed to a boundary C1 (first boundary) between the first range 36*a* and the second range 36*b* of the developing roller 36.

In other words, referring to FIG. 3B, as viewed from a side perpendicular to the axes of the developing roller 36 and the photoconductor drum 32, the abutment part 100 is disposed on the photoconductor drum 32 and on an extended line D1 extending from the boundary C1.

As described above, at the boundary C1, the amount of toner transported from the developing roller 36 to the photoconductor drum 32 and the amount of toner charge tend to change, thus increasing the possibility of adherence of substances to the photoconductor drum 32.

The abutment part 100 is provided to remove the adhering substances. Disposing the abutment part 100 astride the extended line D1 of the boundary C1 is advantageous in efficiently removing the substances adhering to the photoconductor drum 32.

Examples materials of the abutment part 100 include polyacetal (POM). It is to be noted that, although the abutment part 100 is provided on one side in the process unit 31 according to the first embodiment, alternatively, the abutment part 100 may be provided on the line extending from the boundary C1 in each of the end portions. This applies to the subsequent drawings as well.

Figure 4A:
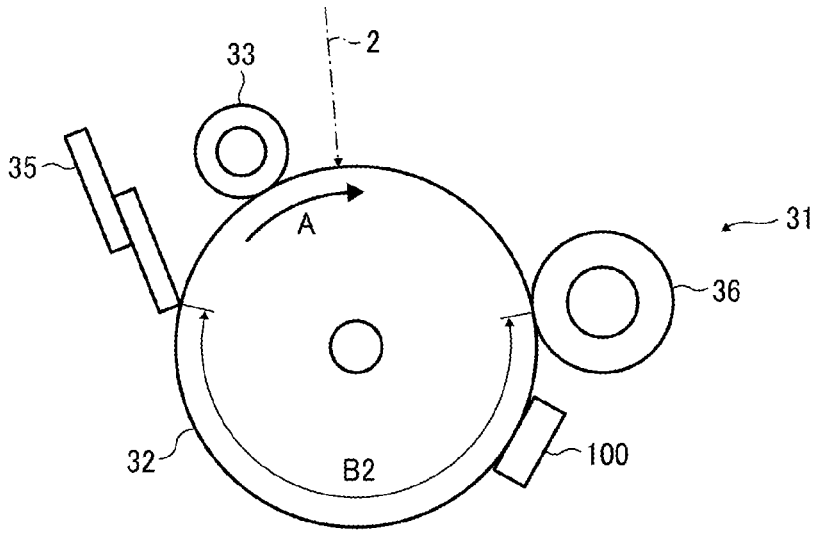
FIGS. 4A and 4B are respectively a schematic end-on axial view and a schematic side view of a process unit according to a second embodiment.
Figure 4B:
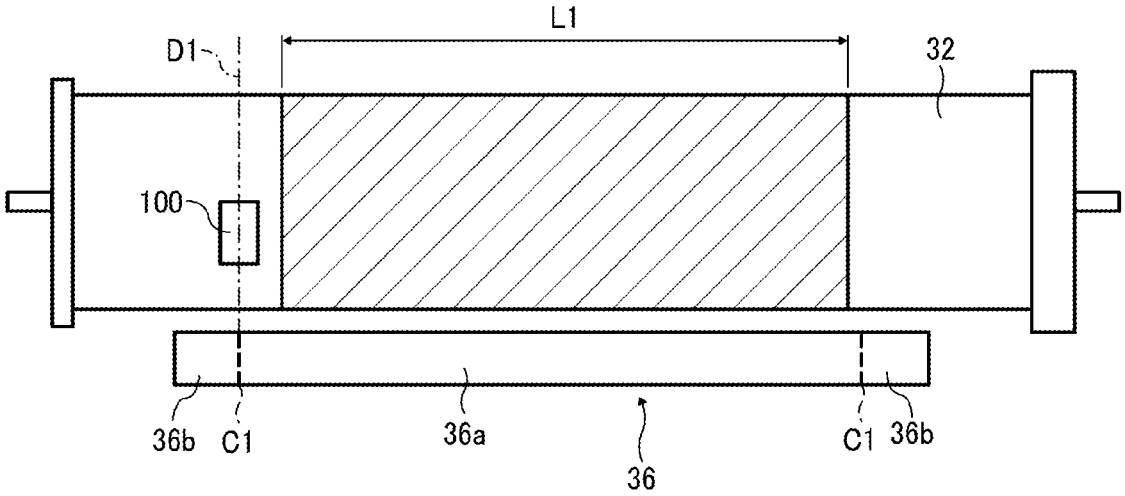

FIGS. 4A and 4B are respectively a schematic end-on axial view and a schematic side view of a process unit according to a second embodiment.

As shown in FIG. 4A, in the process unit 31 according to the second embodiment, the abutment part 100 is disposed facing a range B2 of the photoconductor drum 32, which is downstream from the developing roller 36 and upstream from the cleaning blade 35 in the rotation direction A. Additionally, as shown in FIG. 4B, in the axial direction of the photoconductor drum 32, the abutment part 100 is outside a maximum exposure width L1 (i.e., image area) inside which exposure is performed by the exposure unit 2 for image formation.

In the first embodiment described above, collision of toner against the abutment part 100 is avoided by disposing the abutment part 100 upstream from the developing roller 36. By contrast, in the second embodiment, since the abutment part 100 is disposed outside the image area in which the photoconductor drum 32 bears a toner image, the abutment part 100 does not disturb the toner image even when the abutment part 100 is positioned downstream from the developing roller 36.

Figure 5:
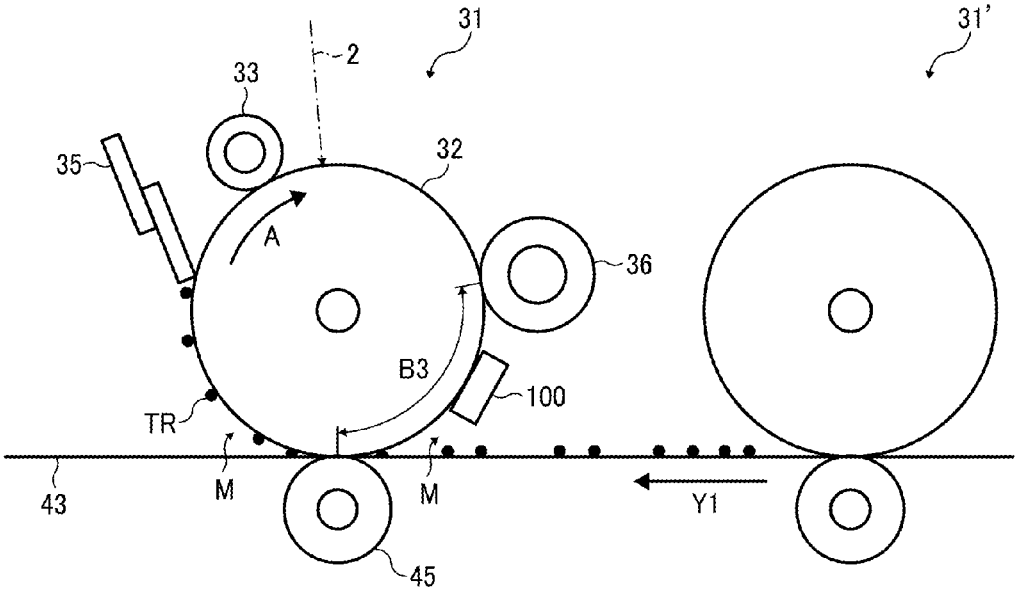
FIG. 5 is a schematic end-on axial view of a process unit according to a third embodiment.

FIG. 5 is a schematic end-on axial view of a process unit according to a third embodiment.

In the process unit 31 according to the third embodiment, the abutment part 100 is disposed in a range B3 downstream from the developing roller 36 and upstream from a transfer position facing the primary-transfer roller 45. A wedgewise space M is defined between the range B3 of the photoconductor drum 32 and the intermediate transfer belt 43.

When the abutment part 100 is disposed downstream from the developing roller 36 and upstream from the cleaning blade 35, the abutment part 100 can be in the space M. With effective use of dead space, the image forming apparatus 1 can become more compact. Not only in image forming apparatuses employing intermediate image transfer but also those employing direct image transfer, the space M is present upstream from the transfer position and between the photoconductor drum 32 and a conveying member such as a conveyance belt to transport sheets to which toner images are transferred. Accordingly, the abutment part 100 can be disposed in the space M similarly.

Additionally, in tandem image forming apparatuses such as the image forming apparatus 1 shown in FIG. 1, in the direction indicated by arrow Y1, in which the intermediate transfer belt 43 rotates, toner transferred from an upstream process unit 31' onto the intermediate transfer belt 43 can be partly transferred reversely to the process unit 31 (the photoconductor drum 32 in particular) on the downstream side. In FIG. 5, the toner thus reversely transferred is given reference character "TR".

At that time, since the abutment part 100 is upstream in the rotation direction A from the transfer position in the third embodiment, the toner TR reversely transferred and remaining on the photoconductor drum 32 can be inhibited from colliding against the abutment part 100, thus inhibiting scattering of toner.

Figure 6:
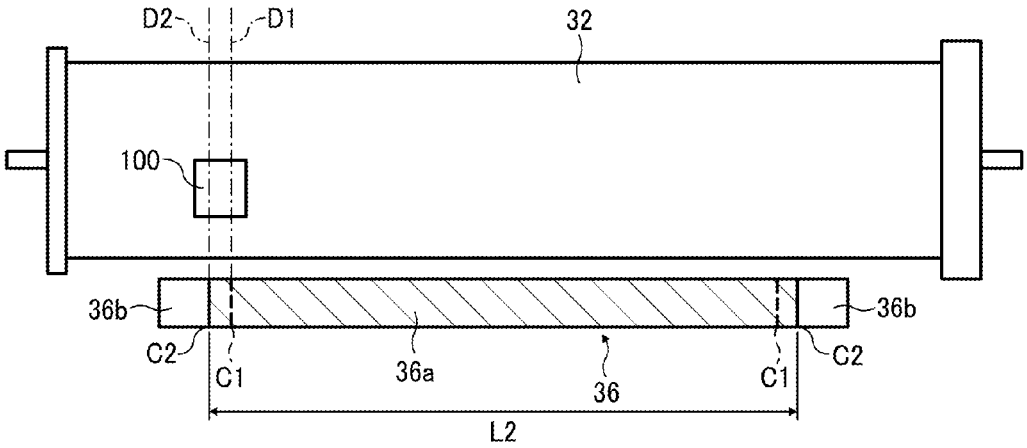
FIG. 6 is a schematic view of a process unit according to a fourth embodiment.

FIG. 6 is a schematic view of a process unit according to a fourth embodiment.

As shown in FIG. 6, the developing roller 36 includes a toner layer range L2 in the axial direction. In the toner layer range L2, the developing roller 36 carries a layer of toner supplied from a supply roller 102 (shown in FIG. 7) of the developing device 34.

The possibility of adherence of substances, such as free substances released from toner, to the photoconductor drum 32 is higher also at a position corresponding to a boundary C2 (second boundary) that defines an end of the toner layer range L2.

Therefore, in the process unit 31 according to the fourth embodiment, the abutment part 100 is disposed on the surface of the photoconductor drum 32 astride a position corresponding to the boundary C2 (on an extended line D2 extending from the boundary C2 to the photoconductor drum 32 in FIG. 6) as well as the position corresponding to the boundary C1. With this arrangement, substances adhering to the extended line D2 and adjacent areas can be removed.

Figure 7:
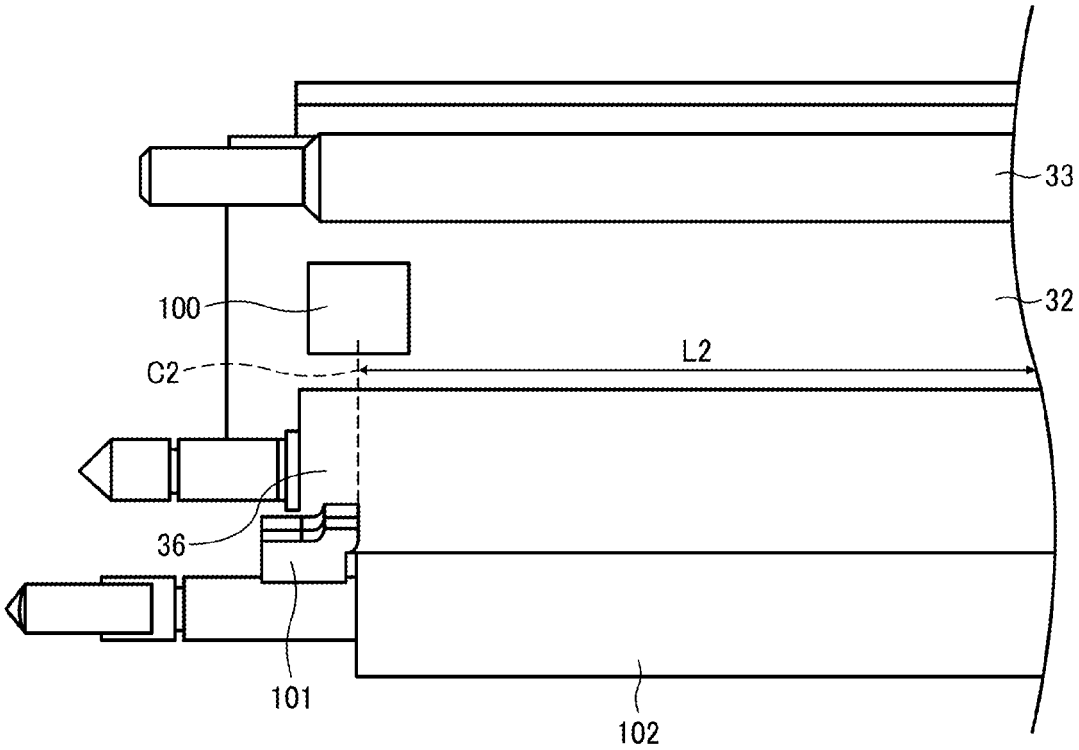
FIG. 7 illustrates relative positions of a supply roller and components of the process unit according to the fourth embodiment.

FIG. 7 illustrates relative positions of the supply roller 102 and other components of the process unit 31 according to the fourth embodiment.

As shown in FIG. 7, the supply roller 102 faces the developing roller 36, and toner is supplied to the developing roller 36 in the range opposed to the supply roller 102. That is, the length of the toner layer range L2 and the position of the boundary C2 thereof in the axial direction are determined by the axial length (i.e., width) of the supply roller 102.

Figure 8A:
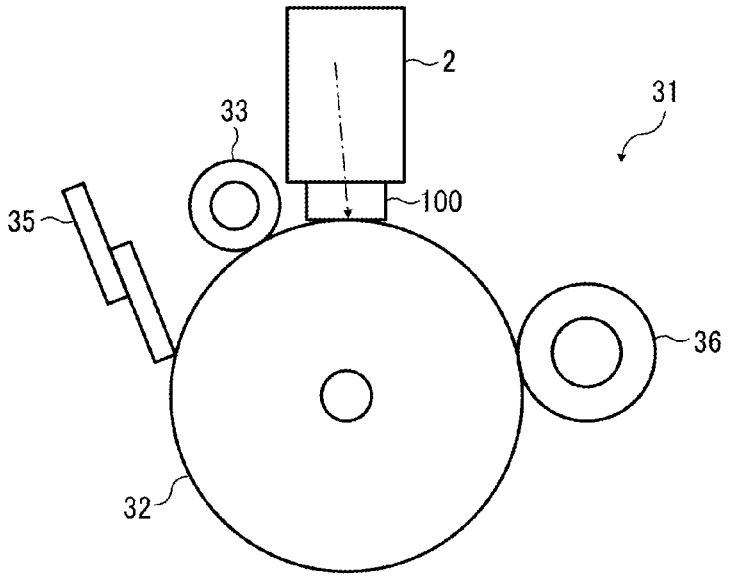
FIGS. 8A and 8B are respectively a schematic end-on axial view and a schematic side view of a process unit according to a fifth embodiment.
Figure 8B:
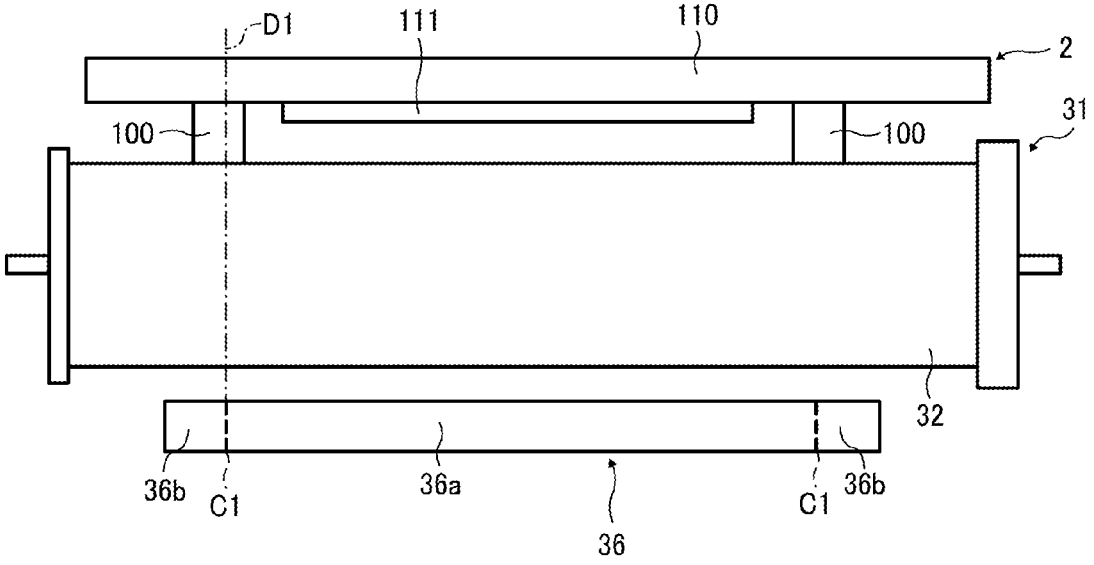

FIGS. 8A and 8B are respectively a schematic end-on axial view and a schematic side view of a process unit according to a fifth embodiment.

As shown in FIG. 8A, in the process unit 31 according to the fifth embodiment, the abutment parts 100 are on the surface of the photoconductor drum 32 and at the positions corresponding to the boundaries C1 at both ends of the developing roller 36. Further, the abutment parts 100 are interposed between the exposure unit 2 and the photoconductor drum 32. The exposure unit 2 includes a holder 110 and a light-emitting diode (LED) head 111 serving as the optical writing device. The LED head 111 is held by the holder 110 and disposed facing the photoconductor drum 32. The abutment part 100 provided to the axial end portions of the photoconductor drums 32 serve as spacers and disposed between the photoconductor drum 32 and the holder 110 to fill in clearances therebetween.

For example, the LED head 111 includes a light-emitting element employing an LED or an organic LED. The LED head 111 irradiates the photoconductor drum 32 with the laser beam from the light-emitting element according to each color separation component, thereby exposing the photoconductor drum 32.

When the LED head 111 exposes the photoconductor drum 32, it is necessary to keep a predetermined distance between the LED head 111 and the photoconductor drum 32 to set a focal length therebetween. When the abutment parts 100 serve as the spacers between the photoconductor drum 32 and the holder 110, the LED head 111 held by the holder 110 can keep a preferable focal length to the photoconductor drum 32. This configuration is also advantageous in inhibiting deviations in relative positions of the photoconductor drum 32 and the LED head 111 even if the position of the photoconductor drum 32 deviates due to rotation or the like.

Additionally, the number of components can be reduced by using the abutment parts 100 to remove substances adhering to the photoconductor drum 32 as the spacers.

FIGS. 10 through 13 are schematic side views of the process unit 31 according to any of the above-described embodiments for understanding of removal of adhering substances using the abutment parts 100. It is to be noted that, in FIGS. 10 through 13, the abutment parts 100 are disposed in the range B1 downstream from the cleaning blade 35 as shown in FIG. 3A, and, in particular, downstream from the charging roller 33 in the range B1 in the rotation direction A.

Figure 10:
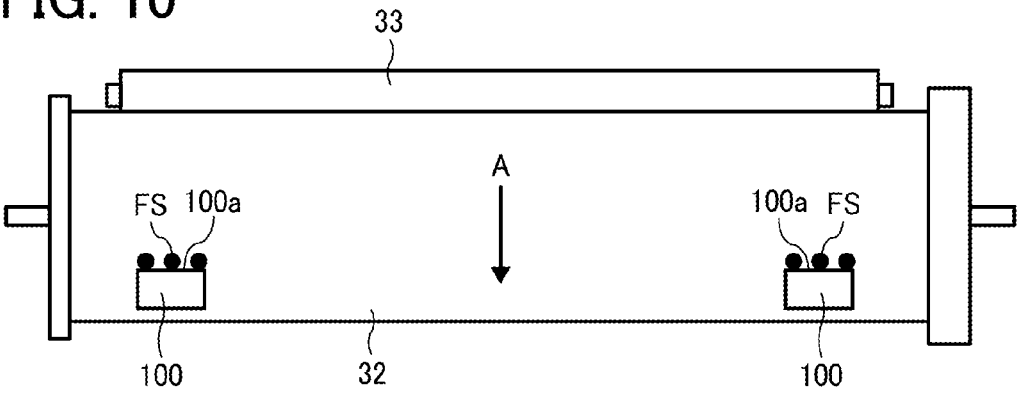
FIG. 10 is a schematic diagram illustrating removal of foreign substances by an abutment part according to an embodiment.

Referring to FIG. 10, when image formation is started, the photoconductor drum 32 rotates in the rotation direction A (i.e., normal rotation direction). At that time, the foreign substances FS (toner and the like) removed from the photoconductor drum 32 by the abutment part 100 accumulate on a face (hereinafter "upstream face 100*a*") of the abutment part 100 on the upstream side in the rotation direction A.

Figure 11:
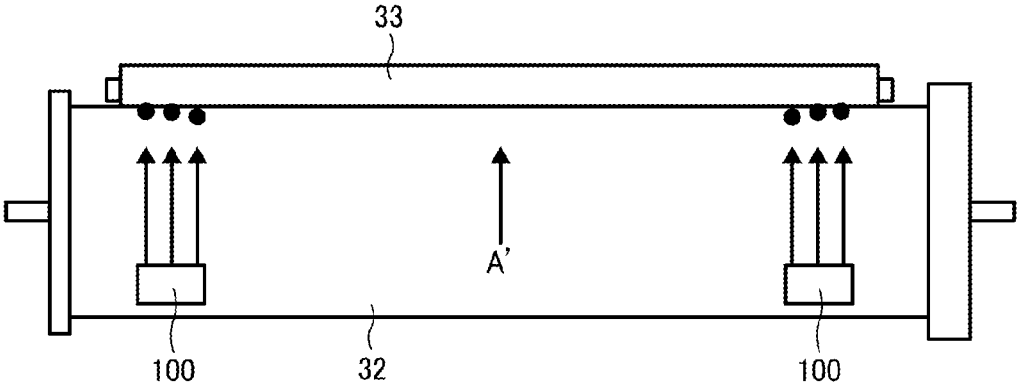
FIG. 11 is a schematic diagram illustrating movement of foreign substances while the photoconductor rotates in reverse.

In such a configuration, as an approach to remove the foreign substances FS that fill the gap between the photoconductor drum 32 and cleaning blade 35, the photoconductor drum 32 may be rotated in reverse. As shown in FIG. 11, when the photoconductor drum 32 rotates in the direction indicated by arrow A' reverse to the rotation direction A for image formation, the foreign substances move toward the charging roller 33.

Figure 12:
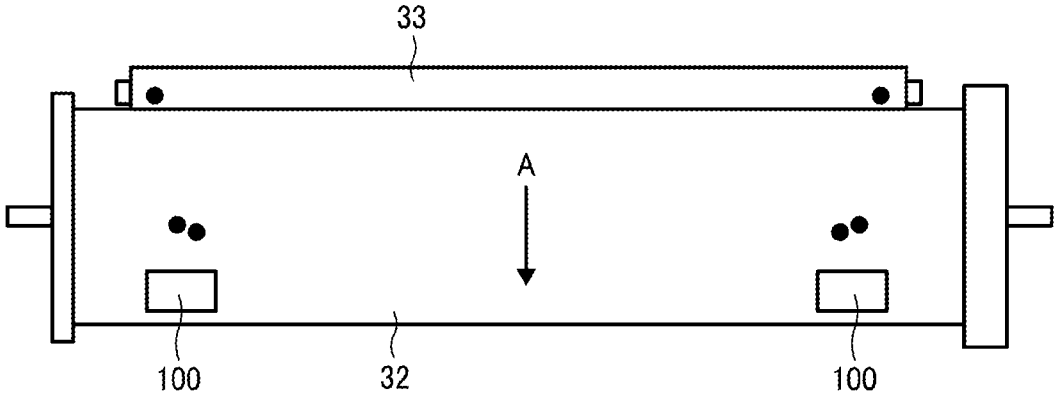
FIG. 12 is a schematic diagram illustrating movement of foreign substances subsequent to the state shown in FIG. 11.

As shown in FIG. 12, the foreign substances then adhere to the surface of the charging roller 33 or the surface of the photoconductor drum 32.

Figure 13:
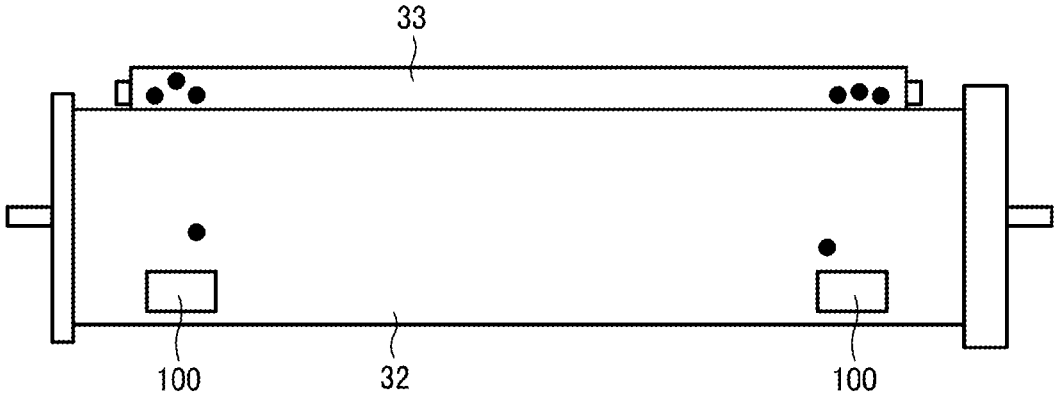
FIG. 13 is a schematic diagram illustrating removal of foreign substances in a configuration shown in FIG. 10.

While the photoconductor drum 32 repeats the normal rotation and the reverse rotation indicated by arrows A and A', the amount of substances adhering to the surface of the charging roller 33 increases as shown in FIG. 13. Then, there is a risk that the charging roller 33 is inhibited from charging the photoconductor drum 32. Additionally, in a case where the photoconductor drum 32 rotates only in the normal direction indicated by arrow A without the reverse rotation indicated by arrow A', the amount of foreign substances accumulating on the abutment part 100 increases. Then, it is possible that the foreign substances overflow and drop on the surface of the photoconductor drum 32, or it becomes difficult for the abutment part 100 to remove the foreign substances from the photoconductor drum 32.

In view of the foregoing, a countermeasure therefore is taken in the following embodiment to maintain reliable image formation for a long time.

Figure 14:
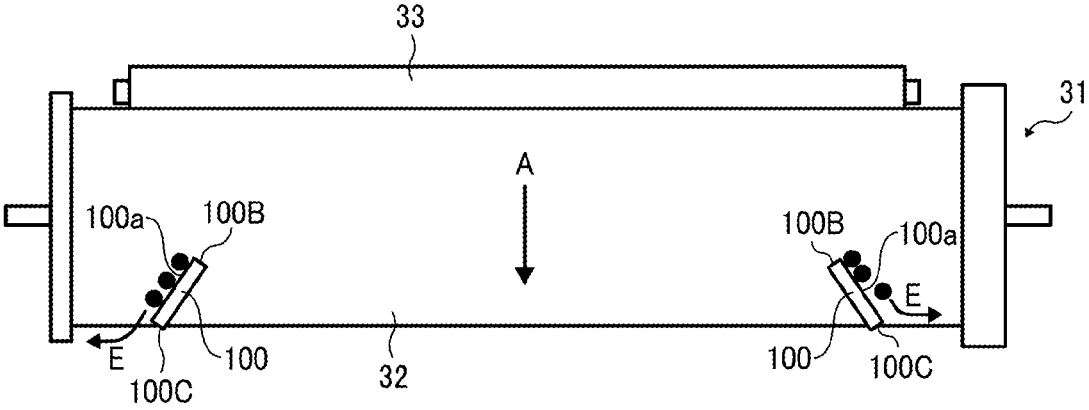
FIG. 14 is a schematic view of a process unit according to a sixth embodiment.

FIG. 14 is a schematic view of a process unit according to a sixth embodiment.

As shown in FIG. 14, in the process unit 31, the abutment part 100 (the upstream face 100*a* in particular) is disposed oblique to the axial direction of the photoconductor drum 32. In FIG. 14, reference character 100B represents an inner end of the abutment part 100 in the axial direction of the photoconductor drum 32, and 100C represents an outer end of the abutment part 100 in that direction. With this placement, the upstream face 100*a* of the abutment part 100 on the upstream side in the rotation direction A of the photoconductor drum 32 is inclined to the outer side in the axial direction (hereinafter "axial outer side") of the photoconductor drum 32 toward the rotation direction A of the photoconductor drum 32.

Specifically, in each abutment part 100, the inner end 100B faces the upstream side in the rotation direction A, and the outer end 100C faces the downstream side in the rotation direction A. In other words, the outer end 100C is downstream from the inner end 100B in the rotation direction A of the photoconductor drum 32. As the photoconductor drum 32 rotates in the rotation direction A, the substances adhering to the surface of the photoconductor drum 32 flow downstream in that direction and are removed by the abutment part 100 from the photoconductor drum 32. Due to the inclination of the abutment part 100, the substances thus removed flow, as indicated by arrow E shown in FIG. 14, to the axial outer side of the photoconductor drum 32. With the abutment part 100 thus inclined to the outer side in the axial direction, the removed substances can escape to the outer side, thus inhibiting the above-described accumulation of foreign substances.

Figure 15A:
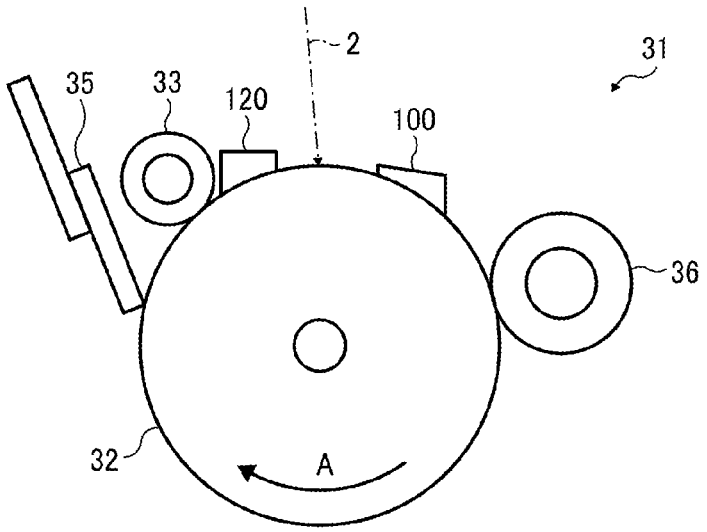
FIGS. 15A and 15B are respectively a schematic end-on axial view and a schematic side view of a process unit according to a seventh embodiment.
Figure 15B:
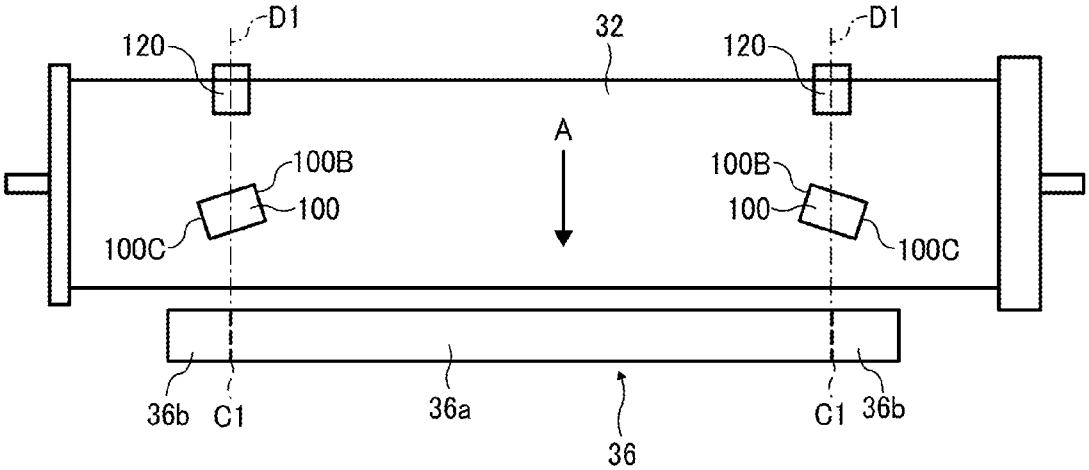

FIGS. 15A and 15B are respectively a schematic end-on axial view and a schematic side view of a process unit according to a seventh embodiment.

As shown in FIG. 15A, the process unit 31 according to the seventh embodiment further includes blocking members 120 to block passage of foreign substances on the photoconductor drum 32 during the reverse rotation of the photoconductor drum 32. The blocking members 120 are disposed downstream from the charging roller 33 and upstream from the abutment part 100 in the rotation direction A of the photoconductor drum 32. Further, similarly to the abutment parts 100, as shown in FIG. 15B, the blocking members 120 are disposed on the surface of the photoconductor drum 32, astride the extended lines D1 extending from the respective boundaries C1 on the surface of the developing roller 36. In other words, the blocking member 120 and the abutment part 100 are on an identical circumference of rotation of the photoconductor drum 32. Additionally, similarly to the sixth embodiment, each abutment part 100 is inclined relative to the axial direction so that the inner end 100B faces the upstream side in the rotation direction A and the outer end 100C faces the downstream side in that direction.

It is to be noted that, although the abutment parts 100 and the blocking members 120 are on both sides in the axial direction of the photoconductor drum 32 in FIG. 15B+, alternatively, the abutment part 100 and the blocking member 120 may be provided to only one side in the axial direction. Additionally, as shown in FIG. 6, the abutment part 100 and the blocking member 120 may be disposed astride the extended line D2 of the boundary C2 of the toner layer range L2.

Figure 16:
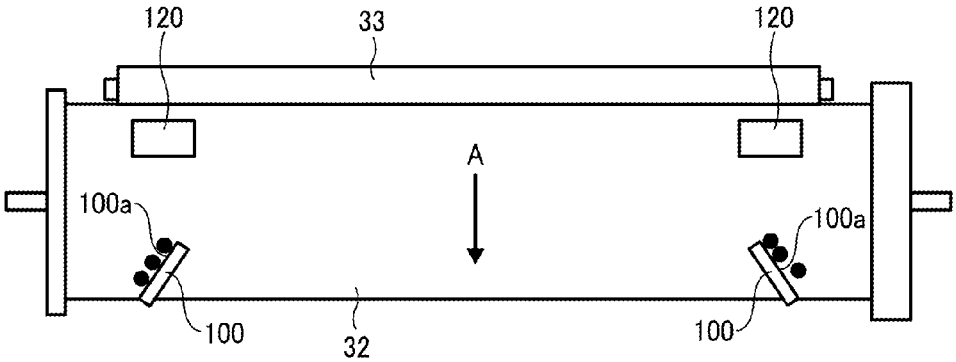
FIG. 16 illustrates removal of foreign substances in the process unit according to the seventh embodiment.
Figure 17:
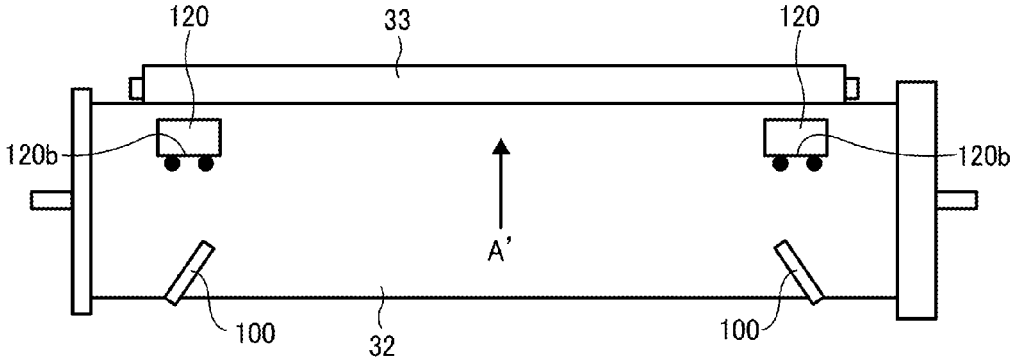
FIG. 17 illustrates removal of foreign substances in the process unit according to the seventh embodiment.
Figure 18:
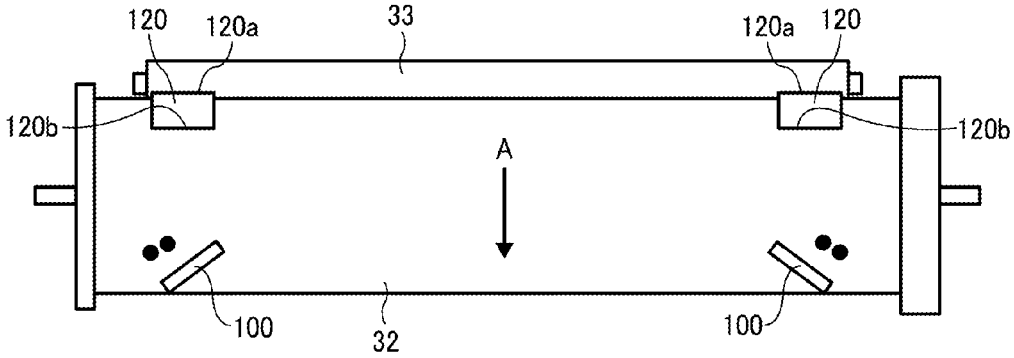
FIG. 18 illustrates removal of foreign substances in the process unit according to the seventh embodiment.

Referring to FIGS. 16 through 18, descriptions are given below of removal of foreign substances in the process unit 31 according to the seventh embodiment.

As shown in FIG. 16, as the photoconductor drum 32 rotates in the rotation direction A for image formation, the foreign substances thereon accumulate on the upstream faces 100*a* of the abutment parts 100 on the upstream side in the rotation direction A. At that time, the accumulating substances partly flow to the outer side in the axial direction since the abutment part 100 is inclined.

Referring to FIG. 17, when the photoconductor drum 32 rotates in reverse as indicated by arrow A', the substances accumulating on the abutment part 100 are returned to the upstream side by the reverse rotation of the photoconductor drum 32 and then accumulate on a face 120*b* of the blocking member 120 on the downstream side in the rotation direction A.

FIG. 18 illustrates a state in which the photoconductor drum 32 rotates again in the rotation direction A. It is to be noted that reference character 120*a* represents a face of the blocking member 120 on the upstream side in the rotation direction A.

As the photoconductor drum 32 rotates in the rotation direction A, the foreign substances again accumulate on the abutment part 100, and a part of those foreign substances flows to the outer side on the photoconductor drum 32 in the axial direction.

Thus, even if the photoconductor drum 32 repeats the normal rotation and the reverse rotation indicated by arrows A and A', the substances removed from the photoconductor drum 32 by the abutment part 100 reciprocate between the abutment part 100 and the blocking member 120 and do not adhere to the charging roller 33. Additionally, the inclination of the abutment part 100 can cause the accumulation on the abutment part 100 to flow to the axial outer side of the photoconductor drum 32. Thus, with the blocking member 120 disposed on the circumference on which the abutment part 100 is positioned, separately from the abutment part 100, the substances removed from the abutment part 100 can be inhibited from accumulating on the surface of the charging roller 33 when the photoconductor drum 32 rotates in reverse. Then, the foreign substances can be blocked by the blocking member 120 and again flow to the abutment part 100 while the photoconductor drum 32 makes normal rotation.

In the above-described sixth embodiment, although the foreign substances accumulating on the abutment part 100 can flow to the outer side due to the inclination of the abutment part 100, there in a risk that, when the photoconductor drum 32 rotates in reverse, the foreign substances accumulating on the abutment part 100 flow to the charging roller 33 and accumulate thereon.

By contrast, in the seventh embodiment, since the blocking member 120 can block the passage of foreign substances, the foreign substances can be inhibited from accumulating on the charging roller 33, and preferable image formation can be maintained. Additionally, it is preferable that the blocking member 120 is positioned at least in a range of the abutment part 100 in the axial direction of the photoconductor drum 32 to secure prevention of accumulation of foreign substances on the charging roller 33.

According to the seventh embodiment, the process unit 31 is provided with three countermeasures, namely, the cleaning blade 35, the blocking member 120, and the abutment part 100, to remove foreign substances such as toner adhering on the photoconductor drum 32. When C100 represents a capability of the abutment part 100 to remove the foreign substances, C35 represents that of the cleaning blade 35, and C120 represents that of the cleaning blade 35, these elements are designed to satisfy the relation of C100>C35>C120.

With such order in the removing capability, in the normal direction of the photoconductor drum 32, the blocking member 120 allows passage of most of foreign substances that are not removed by the cleaning blade 35, and the abutment part 100 on the downstream side can remove those foreign substances.

This configuration is adopted because the blocking member 120 is expected to block passage of foreign substances and cause the foreign substances to accumulate thereon only in the reverse rotation of the photoconductor drum 32. In such a configuration, it is preferred that the blocking member 120 be made of fibers or include a fiber.

Additionally, in this configuration, foreign substances rarely accumulate on the face 120*a* of the blocking member 120 on the upstream side in the rotation direction A while the photoconductor drum 32 rotates in the rotation direction A (i.e., the normal rotation direction). Accordingly, this configuration can reduce the amount of foreign substance that flow from the blocking member 120 toward the charging roller 33 while the photoconductor drum 32 rotates in reverse.

Figure 19:
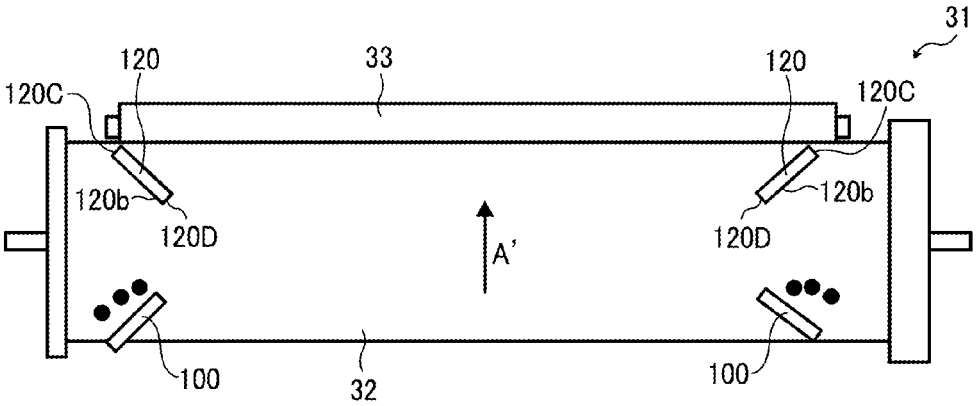
FIG. 19 is a schematic end-on axial view of a process unit according to an eighth embodiment.

FIG. 19 is a schematic end-on axial view of a process unit according to an eighth embodiment.

In FIG. 19, reference character 120C represents an outer end of the blocking member 120 in the axial direction of the photoconductor drum 32, and 120D represents an inner end of the blocking member 120 in that direction.

In the process unit 31 according to the eighth embodiment, not only the abutment parts 100, but also the blocking members 120 are disposed oblique to the axial direction of the photoconductor drum 32. The blocking members 120 are inclined reversely to the abutment parts 100 so that the inner end 120D of the blocking member 120 faces the downstream side in the rotation direction A and the outer end 120C faces the upstream side in the rotation direction A. In other words, the outer end 120C of the blocking member 120 is downstream in the reverse rotation direction A' from the inner end 120D of the blocking member 120.

In the blocking member 120, since foreign substances accumulate on the face 120*b* on the downstream in the rotation direction A, this inclination can direct the foreign substances accumulating thereon to the axial outer side of the photoconductor drum 32. Not only the abutment part 100 but also the blocking member 120 can direct the foreign substances to the axial outer side of the photoconductor drum 32. Accordingly, compared with the seventh embodiment, a greater amount of foreign substances can flow to the outer side, thus better inhibiting accumulation of foreign substances.

Additionally, to ensure that the blocking members 120 direct the foreign substances to the outer side beyond the charging roller 33 in the axial direction, it is preferred that, in the axial direction of the photoconductor drum 32, the outer end 120C of the blocking member 120 be positioned at or beyond an axial end of the charging roller 33 in the axial direction of the photoconductor drum 32.

It is to be noted that, although the abutment parts 100 and the blocking members 120 are oblique to the axial direction of the photoconductor drum 32 in the process units 31 according to the seventh and eighth embodiments, alternatively, both or one of the abutment parts 100 and the blocking members 120 may be parallel to the axial direction. Although the effect of directing foreign substances to the axial outer side of the photoconductor drum 32 is limited, such a configuration can inhibit the inconvenience that the foreign substances once removed accumulate on the charging roller 33 in the reverse rotation of the photoconductor drum 32.

Additionally, the blocking member 120 and the abutment part 100 may be united together although they are separate in the process units 31 according to the seventh and eighth embodiments. That is, a single component having multiple abutment portions against the photoconductor drum 32 may be used instead.

Yet additionally, regarding the placement of the abutment parts 100, although the multiple abutment parts 100 are provided upstream from the developing roller 36 and downstream from the charging roller 33 in the seventh and eighth embodiments, the placement of abutment parts 100 are not limited thereto. For example, one or multiple abutment parts 100 may be disposed between the cleaning blade 35 and the charging roller 33 or disposed in the range B2 shown in FIG. 4A or the range B3 shown in FIG. 5.

Figure 20:
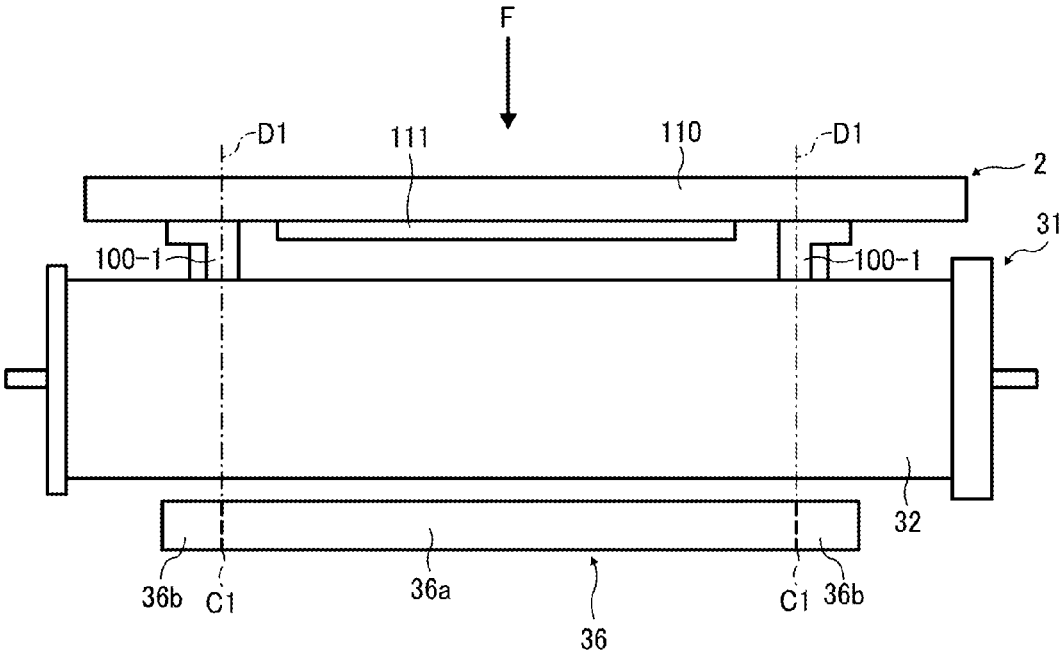
FIG. 20 is a schematic view of a process unit according to a ninth embodiment.

FIG. 20 is a schematic view of a process unit according to a ninth embodiment.

In the process unit 31 according to the ninth embodiment shown in FIG. 20, similar to the fifth embodiment shown in FIG. 8, abutment parts 100-1 are interposed between the photoconductor drum 32 and the exposure unit 2 and serve as spacers to fill in the clearances therebetween. The exposure unit 2 includes the holder 110 and the LED head 111 that is held by the holder 110 and disposed facing the photoconductor drum 32.

Figure 21A:
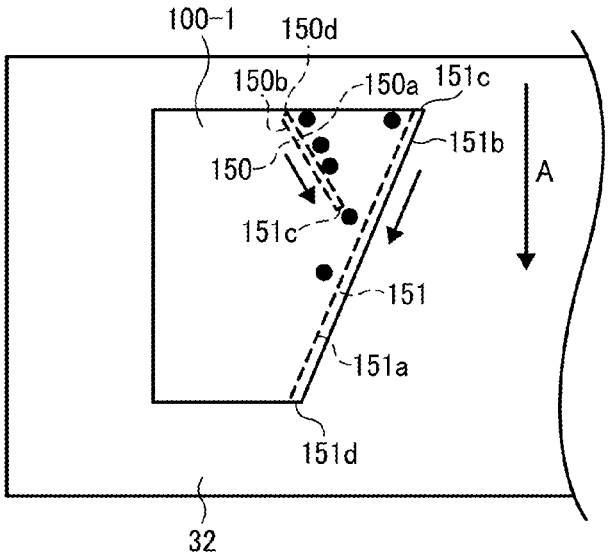
FIG. 21A is a schematic view of a portion where the abutment part shown in FIG. 20 contacts a photoconductor drum in a process unit according to the ninth embodiment, as viewed in the direction indicated by arrow F shown in FIG. 20.
Figure 21B:
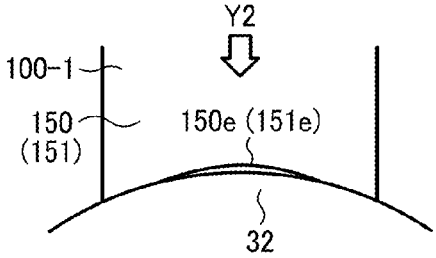
FIG. 21B is an enlarged view of a face of the abutment part shown in FIG. 20.

FIGS. 21A and 21B are schematic views for understanding of removal of foreign substances according to the ninth embodiment. FIG. 21A illustrates the abutment part 100-1 and the photoconductor drum 32 as viewed in the direction indicated by arrow F shown in FIG. 20. FIG. 21B is an enlarged view of a face of the abutment part 100-1 that abuts against the photoconductor drum 32.

In FIG. 21A, reference characters 150*c* and 150*d* respectively represent an inner end and an outer end of the first abutment portion 150 in the axial direction of the photoconductor drum 32, and reference characters 151*c* and 151*d* respectively represent an inner end and an outer end of the second abutment portion 151 in the axial direction of the photoconductor drum 32.

As shown in FIG. 21A, the abutment part 100-1 includes a first abutment portion 150 serving as a blocking member and a second abutment portion 151 that is planer and abuts against the photoconductor drum 32. The first abutment portion 150 and the second abutment portion 151 respectively include an abutment face 150*e* and an abutment face 151*e* that are arced to conform to the circumference of the photoconductor drum 32. Additionally, a diameter of arc of each of the abutment faces 150*e* and 151*e* is smaller than a diameter of the photoconductor drum 32. Therefore, as shown in FIG. 21B, when the abutment faces 150*e* and 151*e* of the first and second abutment portions 150 and 151 contact the surface of the photoconductor drum 32, both ends of the abutment faces 150*e* and 151*e* abut against the photoconductor drum 32, and simultaneously a contact area therebetween increases. This facilitates the abutment.

Additionally, the abutment part 100-1 is pressed toward the photoconductor drum 32 by a bias member such as a spring, and thus the first and second abutment portions 150 and 151 abut against the photoconductor drum 32, conforming to the surface of the photoconductor drum 32.

The first and second abutment portions 150 and 151 are oblique to the axial direction of the photoconductor drum 32 and inclination thereof are opposite to each other. Specifically, the first abutment portion 150 is inclined so that the inner end 150*c* (i.e., a downstream end) faces the downstream side in the rotation direction A, and the outer end 150*d* faces the upstream side in the rotation direction A. In other words, the inner end 150*c* is downstream from the outer end 150*d* in the rotation direction A. By contrast, the second abutment portion 151 is inclined so that the inner end 151*c* faces the upstream side in the rotation direction A, and the outer end 151*d* faces the downstream side in the rotation direction A. In other words, the inner end 151*c* is upstream from the outer end 151*d* in the rotation direction A.

Additionally, the first and second abutment portions 150 and 151 respectively include upstream guide faces 150*a* and 151*a* to guide foreign substances while the photoconductor drum 32 rotates in the rotation direction A (i.e., normal rotation). The upstream guide faces 150*a* and 151*a* face the upstream side in the rotation direction A of the photoconductor drum 32. In the rotation direction A of the photoconductor drum 32, the upstream guide face 150*a* of the first abutment portion 150 is inclined to the axial inner side of the photoconductor drum 32. By contrast, in the rotation direction A of the photoconductor drum 32, the upstream guide face 151*a* of the second abutment portion 151 is inclined to the axial outer side of the photoconductor drum 32. The first abutment portion 150 further includes a downstream guide face 150*b* to guide foreign substance in the reverse rotation of the photoconductor drum 32. The downstream guide face 150*b* faces the downstream side in the rotation direction A of the photoconductor drum 32. Similar to the upstream guide face 150*a* thereof, in the rotation direction A, the downstream guide face 150*b* is inclined to the axial inner side of the photoconductor drum 32.

Additionally, the inner end 150*c* on the downstream side in the rotation direction is disposed adjacent to the second abutment portion 151 across a clearance, and the inner end 150*c* and the second abutment portion 151 are on an identical circumference of rotation. When the photoconductor drum 32 rotates in the rotation direction A (i.e., normal rotation), the foreign substances removed by the first abutment portion 150 can flow to the second abutment portion 151 efficiently, guided by the upstream guide face 150*a*. The foreign substances accumulating on the second abutment portion 151 can flow to the axial outer side of the photoconductor drum 32 along the upstream guide face 151*a* due to the above-described placement.

Figure 22:
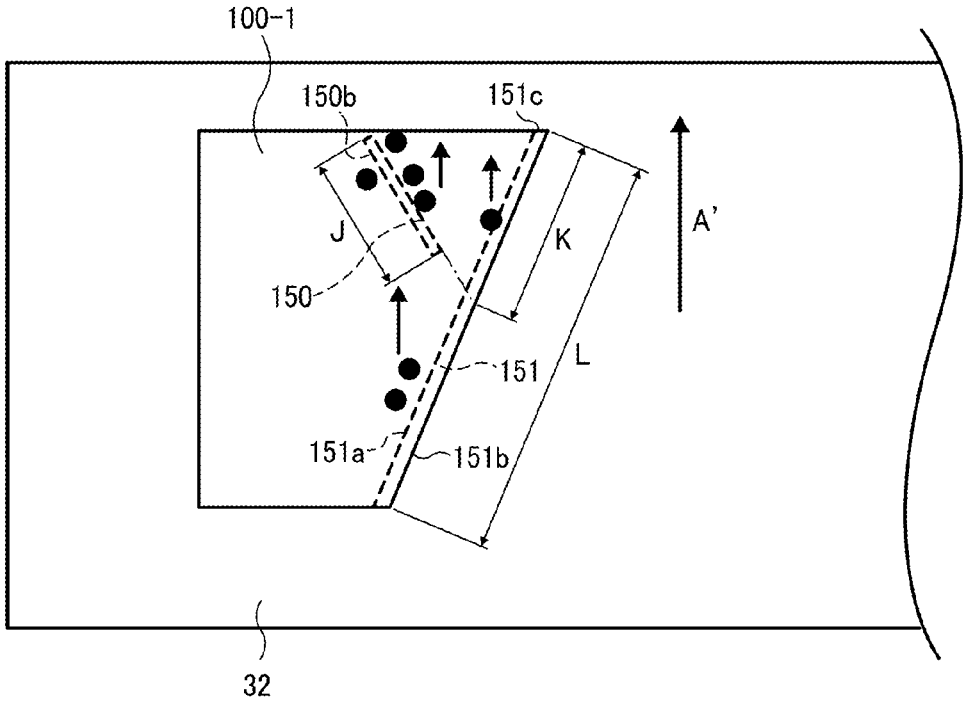
FIG. 22 illustrates removal of foreign substances in the process unit according to the ninth embodiment.

FIG. 22 illustrates a process unit according to the ninth embodiment, being in a state in which the photoconductor drum 32 rotates in the reverse direction.

As shown in FIG. 22, when the photoconductor drum 32 rotates in the reverse direction indicated by arrow A', the foreign substances accumulating on the second abutment portion 151 flow downstream in the direction indicated by arrow A'. At that time, since the first abutment portion 150 is disposed, a part of foreign substances flowing from the second abutment portion 151 accumulates on the first abutment portion 150 and directed by the downstream guide face 150*b* thereof toward the axial outer side of the photoconductor drum 32. This configuration can reduce the accumulation of foreign substances on the charging roller 33 (shown in FIG. 19). Additionally, to ensure that the downstream guide face 150*b* directs foreign substances to the axial outer side beyond the charging roller 33, it is preferred that, in the axial direction of the photoconductor drum 32, an axial outer end of the downstream guide face 150*b* (i.e., an edge between the downstream guide face 150*b* and the outer end 150*d*) be positioned at or beyond the axial end of the area of the photoconductor drum 32 that contacts the charging roller 33.

Referring to FIG. 22, J+K<L is satisfied when J represents a width (an entire width) of the first abutment portion 150, L represents a width (an entire width) of the second abutment portion 151, and K represents a partial width of the first abutment portion 150 (a width from the an upstream end of the second abutment portion 151 to a point of intersection between the downstream face 151*b* and a line extending from the upstream guide face 150*a* of the second abutment portion 151).

When the photoconductor drum 32 rotates in the direction reverse to the direction indicated by arrow A', the foreign substances accumulating in the width J on the first abutment portion 150 flow toward the charging roller 33. Additionally, out of the foreign substances accumulating on the second abutment portion 151 (the upstream guide face 151*a* in particular), the foreign substances accumulating in the width K flow toward the charging roller 33, but the rest accumulates on the downstream guide face 150*b* of the first abutment portion 150.

By contrast, if the first abutment portion 150 serving as the blocking member is not provided, not only the foreign substances accumulating in the width K but also the foreign substances accumulating in the entire width L flow to the charging roller 33 (shown in FIG. 19) in the reverse rotation of the photoconductor drum 32.

From the description above, providing the first abutment portion 150 to satisfy the relation J+K<L can reduce the amount of foreign substances that flow to the charging roller 33 in the reverse rotation compared with the case where the first abutment portion 150 is not provided.

Numerous additional modifications to the above-described embodiments and variations are possible. It is therefore to be understood that, within the scope of the appended claims, the disclosure of this patent specification may be practiced otherwise than as specifically described herein.

Although the above-described embodiments concerns the developing roller in which the surface state or surface property is different over the axial direction, various aspects of the present specification adapt to configurations in which the surface state or surface property is uniform in the axial direction. Specifically, in such developing rollers, it is possible that foreign substances adhere to a position (on the photoconductor drum 32) corresponding to the boundary (C2 in FIG. 6) between the developer layer range and the range where no developer layer is borne on the developing roller. Accordingly, the abutment part 100 can be provided to that position to remove foreign substances similar to the above-described embodiments.

The Image forming apparatus to which various aspects of the present specification are applicable are not limited to the multicolor image forming apparatus shown in FIG. 1 but may monochrome image forming apparatuses, copiers, printers, facsimile machines, or multifunction machines (or MFPs) having these capabilities.

What is claimed is:

1. A process unit comprising:

a rotatable image bearer to bear a toner image on a surface thereof;

a developer bearer to supply developer to the image bearer, the developer bearer including:

a first range;

a second range different in property from the first range, the second range adjacent to and outside the first range in an axial direction of the developer bearer via a first boundary; and a second boundary positioned on an outer side of the first boundary in the axial direction of the developer bearer, a cleaning member to remove residual developer from the surface of the image bearer; and an abutment part disposed to contact the surface of the image bearer to remove a foreign substance from the image bearer, the abutment part disposed astride at least one of:

a first position on the image bearer corresponding to the first boundary of the developer bearer; and a second position on the image bearer corresponding to the second boundary of the developer bearer.

2. The process unit according to claim 1, wherein a difference in property between the first range and the second range of the developer bearer is caused by presence and absence of coating.

3. The process unit according to claim 1, wherein the abutment part is disposed downstream from the cleaning member and upstream from the developer bearer in a normal rotation direction of the image bearer.

4. The process unit according to claim 1, wherein, in the axial direction of the developer bearer, the second boundary of the developer bearer defines an end of a developer layer range to bear a layer of developer.

5. The process unit according to claim 4, wherein the abutment part is disposed downstream from the developer bearer and upstream from the cleaning member in a normal rotation direction of the image bearer, and in the axial direction of the image bearer, the abutment part is disposed outside an image range of the image bearer to bear the toner image.

6. The process unit according to claim 4, wherein the abutment part is disposed astride both of the first position and the second position on the image bearer.

7. The process unit according to claim 1, wherein, in a normal rotation direction of the image bearer, the abutment part is disposed downstream from the developer bearer and upstream from a transfer position where the toner image is transferred from the image bearer.

8. The process unit according to claim 1, wherein the abutment part is interposed as a spacer between the image bearer and an optical writing device to expose the image bearer to position the optical writing device at a predetermined distance away from the image bearer.

9. The process unit according to claim 1, wherein the abutment part comprises polyacetal.

10. The process unit according to claim 1, wherein an upstream face of the abutment part in a normal rotation direction of the image bearer is oblique to the axial direction of the image bearer so that an outer end of the abutment part in the axial direction of the image bearer is downstream in the normal rotation direction from an inner end of the abutment part in the axial direction of the image bearer.

11. The process unit according to claim 1, further comprising a blocking member to contact the surface of the image bearer, wherein the image bearer is to rotate in a normal rotation direction for image formation and a reverse rotation direction reverse thereto, the blocking member is to block passage of the foreign substance on the image bearer while the image bearer rotates in the reverse direction, and the blocking member and the abutment part are disposed on an identical circumference of rotation of the image bearer.

12. The process unit according to claim 11, further comprising a charging member to charge the surface of the image bearer, wherein the blocking member is disposed downstream from the charging member and upstream from the abutment part in the normal rotation direction of the image bearer.

13. The process unit according to claim 11, wherein an upstream face of the abutment part in the normal rotation direction of the image bearer is oblique to the axial direction of the image bearer so that an outer end of the abutment part in the axial direction of the image bearer is downstream in the normal rotation direction from an inner end of the abutment part in the axial direction of the image bearer, and the blocking member comprises a face along the axial direction of the image bearer to receive the foreign substance from the abutment part.

14. The process unit according to claim 11, wherein an upstream face of the abutment part in the normal rotation direction of the image bearer is oblique to the axial direction of the image bearer so that an outer end of the abutment part in the axial direction of the image bearer is downstream in the normal rotation direction from an inner end of the abutment part in the axial direction of the image bearer, and an upstream face of the blocking member in the reverse rotation direction of the image bearer is oblique to the axial direction of the image bearer so that an outer end of the blocking member in the axial direction of the image bearer is downstream in the reverse rotation direction from an inner end of the blocking member in the axial direction of the image bearer.

15. An image forming apparatus comprising:

the process unit according to claim 1; and a transfer device to transfer an image formed by the process unit onto a recording media.

16. The image forming apparatus according to claim 15, further comprising an optical writing device to expose the image bearer, the optical writing device including a light-emitting element that includes at least one of an LED and an organic LED.

17. A process unit comprising:

a rotatable image bearer to bear a toner image on a surface thereof;

a developer bearer to supply developer to the image bearer, the developer bearer including:

a first range;

a second range different in property from the first range, the second range adjacent to and outside the first range in an axial direction of the developer bearer via a first boundary, and a second boundary to define an end of a developer layer range to bear a layer of developer in the axial direction of the developer, the second boundary positioned on an outer side of the first boundary in the axial direction of the developer bearer, a cleaning member to remove residual developer from the surface of the image bearer; and an abutment part disposed to contact the surface of the image bearer to remove a foreign substance from the image bearer, the abutment part disposed on at least one of:

a first line extending to the image bearer from the first boundary of the developer bearer; and a line extending to the image bearer from the second boundary of the developer bearer.

* * * * *